US009228728B2

(12) United States Patent
Van Hoof et al.

(10) Patent No.: US 9,228,728 B2
(45) Date of Patent: Jan. 5, 2016

(54) LUMINAIRE MODULE

(71) Applicant: KONINKLIJKE PHILIPS N.V., Eindhoven (NL)

(72) Inventors: Willem Piet Van Hoof, Horst (NL); Michel Cornelis Josephus Marie Vissenberg, Roermond (NL); Andreas Aloysius Henricus Duijmelink, Helmond (NL); Mark Johannes Antonius Verhoeven, Deurne (NL); Melike Yavuz, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/379,516

(22) PCT Filed: Feb. 15, 2013

(86) PCT No.: PCT/IB2013/051226

§ 371 (c)(1),
(2) Date: Aug. 19, 2014

(87) PCT Pub. No.: WO2013/124770

PCT Pub. Date: Aug. 29, 2013

(65) Prior Publication Data

US 2015/0055344 A1 Feb. 26, 2015

Related U.S. Application Data

(60) Provisional application No. 61/602,224, filed on Feb. 23, 2012.

(51) Int. Cl.

| | |
|---|---|
| ***F21V 21/002*** | (2006.01) |
| ***F21S 2/00*** | (2006.01) |
| ***F21V 21/005*** | (2006.01) |

(Continued)

(52) U.S. Cl.

CPC ..... *F21V 21/002* (2013.01); *F21S 2/005* (2013.01); *F21V 21/005* (2013.01); *F21V 23/06* (2013.01); *F21Y 2101/02* (2013.01)

(58) Field of Classification Search

USPC ..... 362/249.02, 249.07, 249.11, 249.14, 362/249.15, 249.16, 238, 363, 367, 806

See application file for complete search history.

(56) References Cited

U.S. PATENT DOCUMENTS

| | | | |
|---|---|---|---|
| 6,796,680 | B1 | 9/2004 | Showers et al. |
| 6,851,831 | B2 | 2/2005 | Karlicek, Jr. |
| 7,160,140 | B1 | 1/2007 | Mrakovich et al. |

(Continued)

FOREIGN PATENT DOCUMENTS

| | | | |
|---|---|---|---|
| BE | 1018085 | A3 | 4/2010 |
| CN | 201251038 | Y | 3/2009 |

(Continued)

*Primary Examiner* — Laura Tso

(74) *Attorney, Agent, or Firm* — Meenakshy Chakravorty

(57) ABSTRACT

A luminaire module (1) arranged to radiate light in all directions is disclosed. It comprises a plurality of sections (5, 6) each having an LED (7) and at least one electrical terminal (3, 4) opposing said LED (7). The sections (5, 6) are attachable to each other with their LED's (7) facing outwardly so that the electrical terminals (3, 4) of each section (5, 6) face each other within the luminaire module (1). The sections (5, 6) are attachable to each other in spaced relation A lighting network comprises a plurality of luminaire modules (1), wherein the luminaire modules (1) are coupled to each other in a three dimensional form.

14 Claims, 6 Drawing Sheets

(51) Int. Cl.
*F21V 23/06* (2006.01)
*F21Y 101/02* (2006.01)

(56) References Cited

U.S. PATENT DOCUMENTS

| | | | | |
|---|---|---|---|---|
| 7,572,027 | B2 | 8/2009 | Zampini, II et al. | |
| 2002/0141181 | A1 | 10/2002 | Bailey | |
| 2002/0176253 | A1 | 11/2002 | Lee | |
| 2005/0099810 | A1* | 5/2005 | Tasson et al. | 362/250 |
| 2005/0152142 | A1 | 7/2005 | Traynor | |
| 2006/0134978 | A1* | 6/2006 | Rosen et al. | 439/581 |
| 2009/0021939 | A1 | 1/2009 | Costello et al. | |
| 2009/0256500 | A1* | 10/2009 | Hoover et al. | 315/313 |
| 2009/0296381 | A1 | 12/2009 | Dubord | |
| 2010/0207502 | A1* | 8/2010 | Cao et al. | 313/46 |
| 2012/0243244 | A1* | 9/2012 | Wan et al. | 362/432 |
| 2012/0257374 | A1* | 10/2012 | Daniel | 362/84 |

FOREIGN PATENT DOCUMENTS

| | | | |
|---|---|---|---|
| WO | 2004023033 | A1 | 3/2004 |
| WO | 2006044859 | A2 | 4/2006 |
| WO | 2011006725 | A1 | 1/2011 |

* cited by examiner

LUMINAIRE MODULE

CROSS-REFERENCE TO PRIOR APPLICATIONS

This application is the U.S. National Phase application under 35 U.S.C. §371 of International Application No. PCT/IB13/051226, filed on Feb. 15, 2013, which claims the benefit of U.S. Provisional Patent Application No. 61/602,224, filed on Feb. 23, 2012. These applications are hereby incorporated by reference herein.

FIELD OF THE INVENTION

This invention relates to a luminaire module that can be connected to other luminaire modules to build dot-in-space lighting networks. The invention also relates to a lighting network formed from a plurality of luminaire modules according to the invention.

BACKGROUND OF THE INVENTION

Dot-in-space light networks comprise a network of luminaire modules that are suspended in a discrete grid to give the appearance that each luminaire module is remote and independent from each of the other luminaire modules forming the lighting network. They are widely used in decorative lighting and with the advent of LED lighting are becoming ever more popular. They can be used to light areas for functional lighting or for decorative or artistic appearance purposes.

Typically, luminaires for dot-in-space lighting networks are positioned at the end of a connecting rod that supplies power, data, or power and data for addressing the dots as well as supporting the luminaire module. Alternatively, luminaire modules are attached at various points on a continuous cable from which the luminaire modules are suspended. A common example is Christmas tree lights that usually comprise a plurality of light sources arranged in series or in parallel along a power cable. The arrangement of the luminaire modules is not changeable and these networks are ineffective at forming three-dimensional grids. Furthermore, the luminaire modules can only be connected one-after-another along the cable so power distribution is not very efficient.

A two-part luminaire module is known from U.S. Pat. No. 7,160,140 B1, which is clamped in position on a cable. The clamp electrically and physically connects the luminaire module to the cable. The limitation of this type of network is that the connections between the luminaire modules are linear—they can only be connected one after another along the cable.

A requirement exists for a flexible luminaire module for use in a dot-in-space lighting network and in which a plurality of luminaire modules can be easily connected and supported in different ways to form three dimensional lighting networks.

SUMMARY OF THE INVENTION

According to the invention, there is provided a luminaire module arranged to radiate light in all directions, comprising a plurality of sections each having an LED and at least one electrical terminal on opposing surfaces, the sections being attachable to each other with their LED's facing outwardly so that the electrical terminals of each section face each other within the luminaire module, wherein the sections are attachable to each other in spaced relation.

As the modules are formed in sections, each with their own light source, the divisions between the sections provide space for interconnecting the module to other modules, mechanically and/or electrically. The space between the sections also provides room for driver electronics and controls or improves heat dissipation.

In one embodiment, the sections are attachable to each other in spaced relation to enable conductors for supplying DC or AC power to the electrical supply terminals of each section to extend into said luminaire module from different directions. This enables multiple luminaire modules to be connected together in different three-dimensional structures.

The sections may instead be attachable to each other in spaced relation to enable conductors for supplying control signals to the electrical terminals of each section to extend into said luminaire from different directions.

The conductors may provide AC or DC power and control signals to the electrical terminals of each section.

The sections may also be attachable to each other in spaced relation to enable support members for supporting the luminaire module to extend into said luminaire module from different directions. Rather, or in addition to, power supply cables, luminaire module support members, such as rigid rods, may extend into the space between the sections and thereby attach to the luminaire module so as to enable multiple luminaire modules to be connected together in different three-dimensional structures. The power supply cables may extend through rigid rods used to support the modules or, run along the outside of the rods.

In some embodiments, the luminaire module may comprise two sections arranged back-to-back. In this embodiment, the sections may then be configured to receive a coupling ring positioned between them. The ring is attached to a cable and configured to make electrical contact with the electrical terminals of each section.

Preferably, the cable extends from a perimeter edge of said ring and the ring is positionable between the sections so that the cable extends from the luminaire module in any direction.

The coupling ring can include an electrical circuit that aligns with electrical terminals in each section irrespective of the direction in which the cable extends from said section, so that power and/or control signals are supplied to said LED's via said rings. This enables power and/or control signals to be supplied to the LED's irrespective of the position of the rings, so that the cables can extend from the luminaire module in any direction.

In another embodiment, the luminaire module may comprise a plurality of connecting rings between the sections in stacked relation to connect a plurality of cables to the luminaire module such that each cable extends from said luminaire module in a different direction.

The sections may be attached to each other via a threaded connection that extends through the centre of each ring and retains the/or each ring in position within the luminaire module.

In an alternative embodiment, the sections are configured so that, when attached to each other, they together form a channel around the outside of the luminaire module. A member can then be attached to the end of a cable which is captured within said channel. In some embodiments, the member and the channel can be configured to electrically connect the cable to the electrical terminals in each section.

In a modified embodiment, a mechanical biasing member is attached to the cable and biases said member against a wall of the channel to maintain electrical connection between the member and the channel.

In an alternate embodiment, the cable can be a snap-fit into the channel between the sections.

In another embodiment, the luminaire module comprises four sections, each section being attachable to each other in spaced relation to enable conductors for supplying power and/or control signals to the electrical terminals of each section to extend into said luminaire module from different directions.

Each section may have a translucent cover that extends over its associated LED to enclose each section. The cover may be arcuate in shape so that, when the covers have been attached to each section, the luminaire module is substantially spherical in shape.

According to the invention, there is also provided a lighting network comprising a plurality of luminaire modules. The luminaires are coupled to each other in a three dimensional form.

The capability of the luminaire modules to connect to multiple other luminaire modules enables the light network to be constructed with flexibility. Dot-in-space networks can be created by connecting the luminaire modules in a grid or web design.

BRIEF DESCRIPTION OF THE DRAWINGS

Preferred embodiments will now be described, by way of example only, with reference to the accompanying drawings, in which.

DETAILED DESCRIPTION

Dot-in-space light networks preferably have multiple connections extending between each of the luminaire modules. These connections must support the luminaire modules and provide power and possibly control signals. Some examples of dot-in-space light networks can be seen in FIGS. 1*a* to 1*j* and demonstrates how different connections between luminaire modules can create different functional and decorative light networks. It is desirable for the connections to have as much flexibility as possible in terms of the positioning and direction between luminaire modules so that a custom light network, like those shown in FIGS. 1*a* to 1*j*, may be created.

Figures 1A, 1B, 1C, 1D, 1E, 1F, 1G, 1H, 1I, 1J:
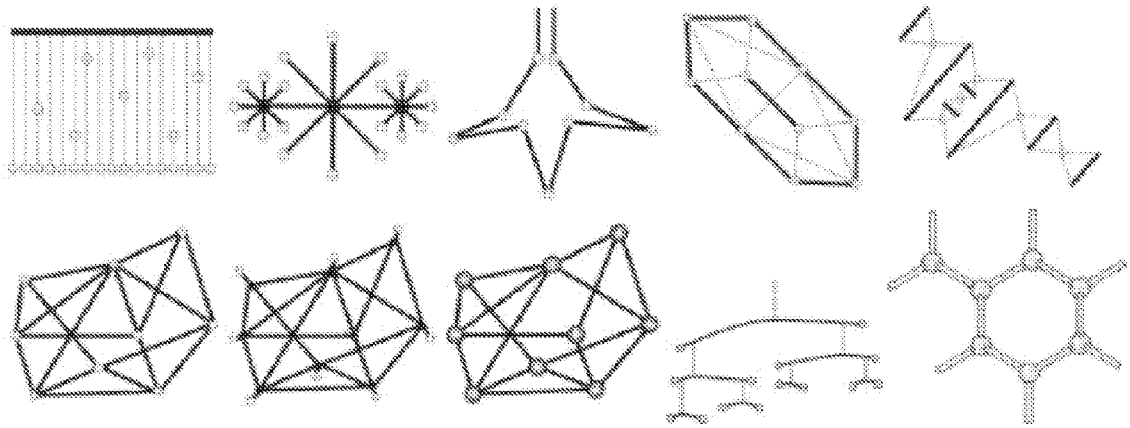
FIGS. 1*a* to 1*j* show different examples of various dot-in-space type lighting networks that may be formed using a plurality of luminaire modules according to an embodiment of the invention.
Figure 2A:
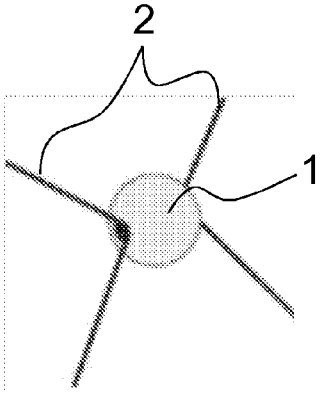
FIGS. 2*a* to 2*c* show a first embodiment of the invention wherein a two section luminaire module is suspended between two cables.

FIG. 2*a* shows a first embodiment of a luminaire module 1 according to an embodiment of the invention. The luminaire module 1 is suspended between two cables 2 that support and provide power to the luminaire module.

Figure 2B:
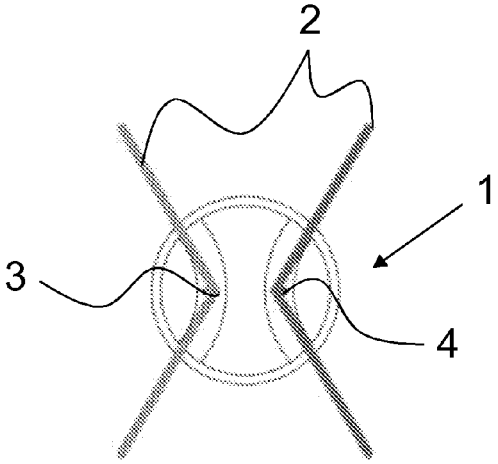

FIG. 2*b* shows a cross section of the embodiment of FIG. 2*a*. The two suspension cables 2 pass through the luminaire module 1 and an electrical contact is created between the cables 2 and electrical terminals 3, 4 that, in this drawing, extend perpendicular to the plane of the paper. In order to maintain the electrical contact and keep the luminaire module 1 adequately suspended the cables 2 pull in opposite directions. This limits the different configurations that can be achieved but does offer a simple network arrangement. In the event that there is only one cable (carrying two conductors insulated from each other), the weight of the luminaire module may be relied upon to maintain the cable against the electrical contacts in the luminaire module.

Figure 2C:
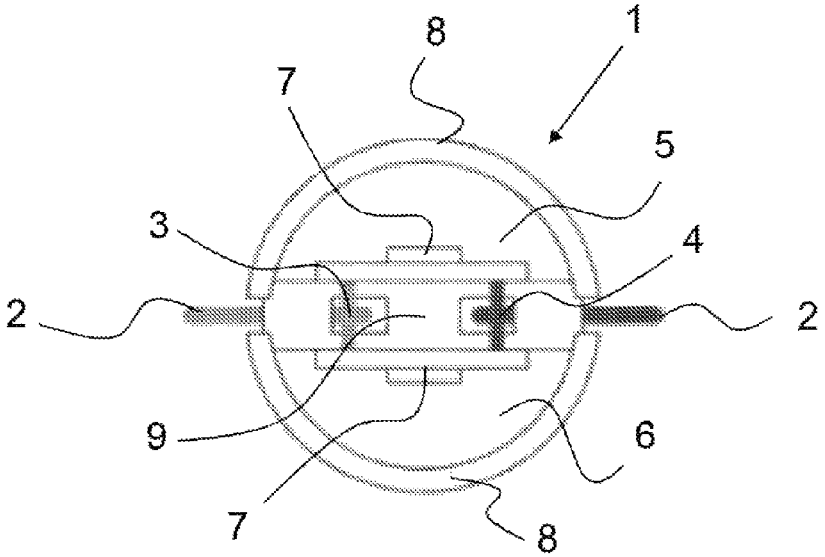

FIG. 2*c* shows a cross sectional end view of the embodiment of FIGS. 2*a* and 2*b*. The luminaire module 1 comprises two sections 5, 6 that are connected to each other in spaced relation. Suspension cables 2 extend into the luminaire module 1 between the two sections 5,6. Each section 5, 6 comprise an LED 7 and a translucent part-spherical casing 8. The electrical terminals 3, 4 extend from one LED 7 to the other to create an electrical circuit. The suspension cables 2 are oppositely connected to a power source (not shown), and the cables 2 are coupled to respective electrical terminals 3,4 so that an electric circuit is created through the LED's 7. The spherical casing 8 ensures that light is more evenly emitted in substantially all directions from the luminaire module 1. The central region 9 between the LED's 7 provides space for extra components (not shown), such as control hardware, or an area for heat dissipation.

Figure 3A:
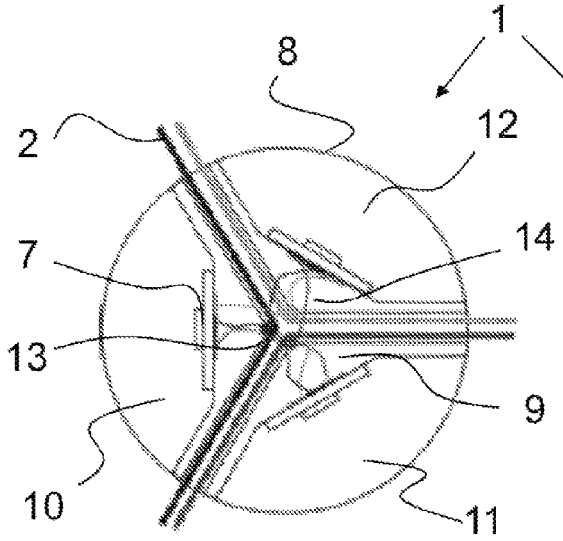
FIGS. 3*a* and 3*b* show embodiments of the invention with three sections.

FIG. 3*a* shows a luminaire module 1 suspended between three cables 2 to support the section 1 and provide electrical power. The luminaire module 1 comprises three sections 10, 11, 12, each comprising an LED 7 and a part-spherical translucent casing 8. Each section 10,11,12 is releasably attached to the remaining two sections 10,11,12 using conventional fixings, so that the section 1 may be installed in, or removed from, the lighting network. The region 9 that is provided between the sections 10,11,12 provides a space to receive the connecting cables 2. Each cable 2 enters through the spaces between the sections 10,11,12. In the centre of the luminaire module, behind the LED's 7, each cable 2 is connected to an electrical terminal 13, which is in turn connected to each of the LED's 7 by small wires 14. The connecting cables 2 provide both the power and physical support for the luminaire module 1. Together, the three sections 10, 11, 12 form a spherical body that emits light in substantially all directions through the spherical casing. The section 1 is connectable to other sections by the cables 2 which extend from the section 1 in multiple different directions. In the drawing, the three cables 2 are shown as co-planar, i.e. they all lie in the plane of the page. However, it will be appreciated that one or more of the cables can extend from the section at an angle relative to the plane of the page.

Figure 3B:
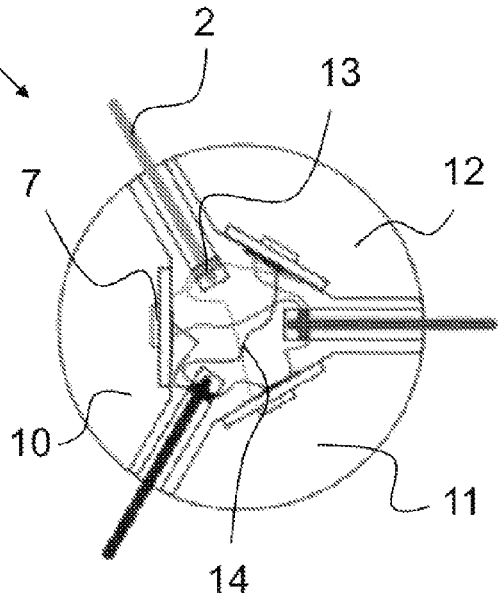

FIG. 3*b* shows a similar embodiment to that of FIG. 3*a*. The luminaire module 1 comprises three sections 10, 11, 12 with spaces between to receive the connecting cables 2. In this case, each cable 2 is terminated and anchored to the luminaire module 1 at the contacts 13, so that the luminaire module 1 is suspended or held in place by the cables 2. Each cable 2 is then appropriately connected to the LED's 7 by small wires 14 or other connections within the section 1. One or more of the cables may also extend through hollow, rigid rods that are attached to and support the section 1.

Figure 4A:
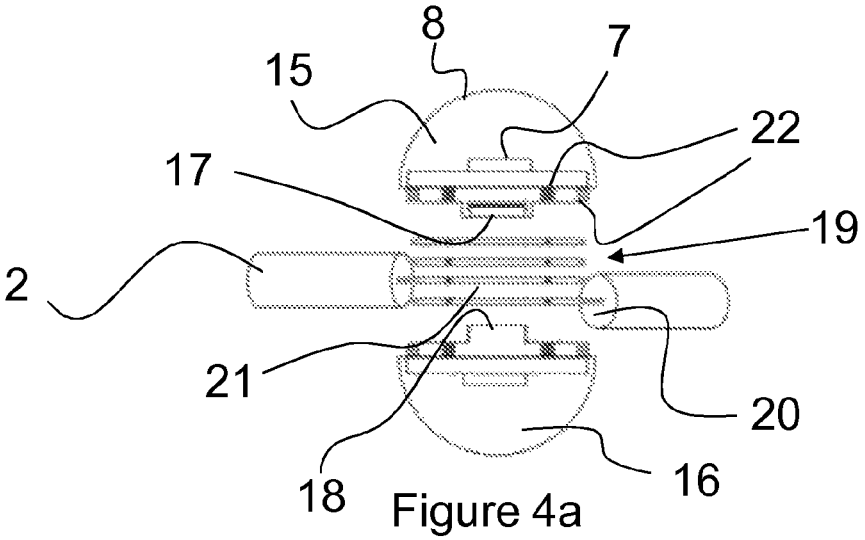
FIGS. 4*a* to 4*e* show further embodiments of the invention, wherein the connecting cables comprise rings that are positioned between the sections.

FIG. 4*a* shows an exploded view of another embodiment of the luminaire module 1 comprising two sections 15, 16; the first section 15 comprises a female threaded portion 17 for receiving a male threaded portion 18 of the second section 16 to connect the sections 15, 16 together. Each section also comprises an LED 7 and a semi-spherical translucent casing 8. When assembled, the casing 8 of each section 15,16 causes light to be emitted in substantially all directions, giving the effect of a dot-in-space.

The area 19 between the two sections 15,16 provides a space to attach the connecting cables 2. The ends 20 of the connecting cables 2 comprise connecting rings 21 that are located between the sections 15, 16. Each section 15, 16 comprises electrical terminals 22 that make contact with electrically conductive circuits in the connecting rings 21 so that power is transmitted through said rings 21 to the LED's. The threaded connection 17, 18 between the sections 15, 16 engages through central apertures of the rings to connect the sections 15,16 together with the rings 21 therebetween. In this arrangement, multiple connecting rings 21 can be positioned between the sections 15, 16 in stacked relation, so that the luminaire module 1 may be attached to multiple other luminaire modules 1. The number of possible connections is limited by the length of the threaded connection between the sections 15, 16, i.e. the maximum spacing between the sections 15, 16 to receive rings 21.

Figure 4B:
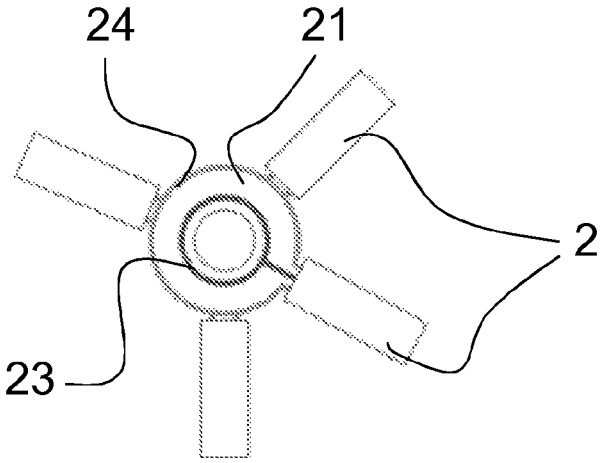

FIG. 4*b* shows a top view of the connecting rings comprising an inner electrical contact loop or circuit 23 and an outer electrical contact loop 24 embedded in each ring. Each loop carries an opposing charge forming an electric circuit with the LED's 7. When the rings 21 are stacked the electrical contact loops 23, 24 are aligned and form a conducting link between the sections 15, 16. The embodiment shown in FIG. 4 shows two conducting rings, however, it will be appreciated that more conducting rings can also be attached to carry control signals or to provide an electrical ground. The inner electrical contact loop 23 is only connected to one connecting cable 2 and the outer electrical contact loop 24 is connected to all of the connecting cables 2. In this way, electrical power is conducted through all of the rings 21 and through the electrical terminals 22 in each section 15, 16 to power the LED's 7. The configuration of the connecting cables 2 and connecting rings 21 means that the network of luminaire modules 1 is connected in parallel.

It will be appreciated that the rings 21 may be rotated relative to each other and to each of the sections 15, 16 so that the power supply cables 2 can extend in any direction from the luminaire module 1, without affecting the electrical connection between the power supply cables and the LED's in each section. It will be appreciated that the cables may comprise conductive rods or cables may run through conductive rods that are attached to the luminaire module.

Figure 4C:
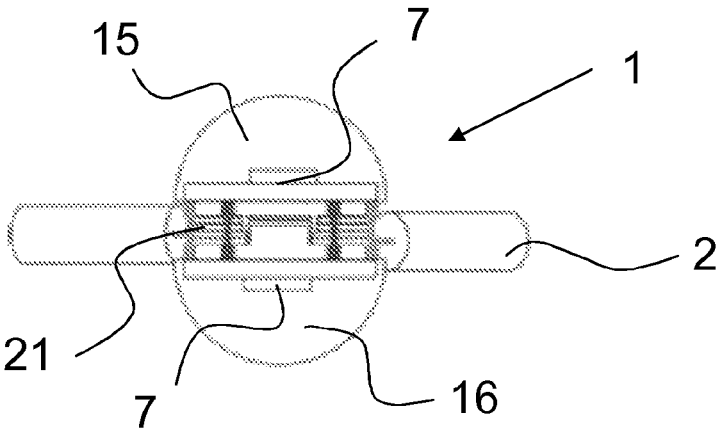

FIG. 4*c* shows the assembled luminaire module 1 and shows that a conducting link is formed between the LED's 7 via the connecting rings 21.

Figure 4D:
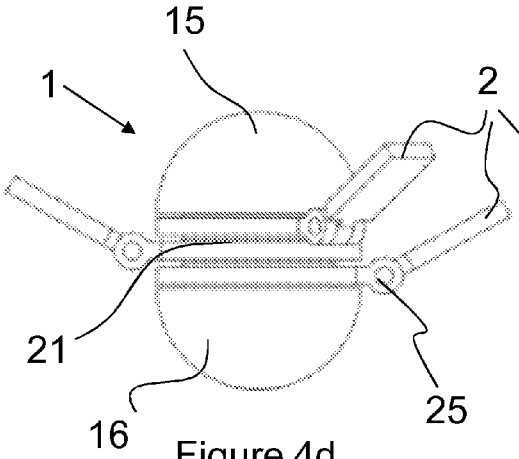

FIG. 4*d* shows an embodiment of the luminaire module 1 similar to that shown in FIGS. 4*a* to 4*c*, wherein the connecting cables 2 comprise connecting rings 21 that are located between the sections 15,16 and provide electrical connections to the sections. In this embodiment, the connecting cables 2 comprise hinges 25 to hingedly attach to the connecting rings 21, giving a further degree of freedom to the connections.

Figure 4E:
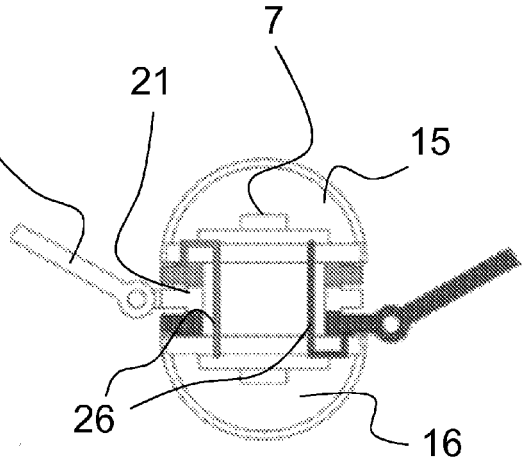

FIG. 4*e* shows how the connecting rings 21 of FIG. 4*d* provide an electrical connection to the sections 15,16 and the LED's 7. In this embodiment, which is equally applicable to the embodiments of FIG. 4*a* to 4*c*, only the top and bottom connecting rings carry an electrical current and are electrically connected to the LED's 7. The top and bottom connecting rings carry opposite charges and the sections 15,16 and LED's 7 are electrically connected by conductance members 26. The electrical circuit is formed between the top and bottom connecting rings, via the LED's 7 and conductance members 26. Any middle connecting rings are insulators and act only to physically support the luminaire module 1. In this way, luminaire modules 1 in a network are connected in series.

Figure 5A:
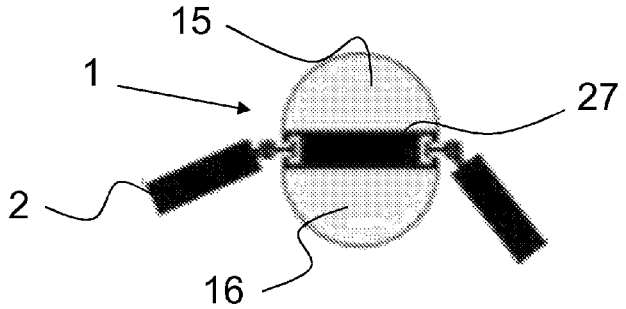
FIGS. 5*a* to 5*f* show different embodiments for attaching the connecting cables to the luminaire module.

FIG. 5*a* shows another embodiment of the invention. The luminaire module 1 comprises two semi-spherical sections 15, 16 with a circumferential connecting track 27 in between. The connecting track 27 receives connecting cables 2 that connect the luminaire module 1 to other luminaire modules.

Figure 5B:
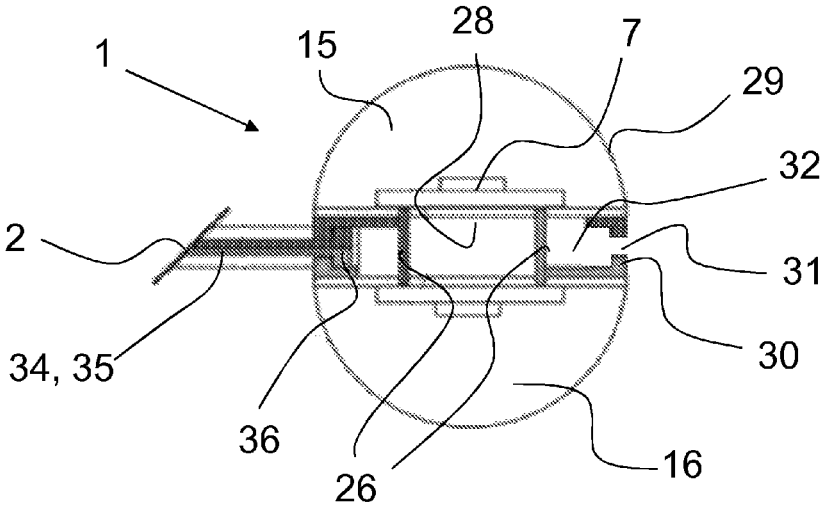

FIG. 5*b* shows a further embodiment of the invention. The luminaire module 1 is formed of two sections 15, 16, each section comprising a flat face 28, a semi-spherical face 29 and an LED 7 positioned within the semi-spherical part, which is translucent. The flat faces 28 comprise connecting means (not shown), such as a threaded connection or a snap-fit mechanism, to connect the sections to each other so that when they are connected together the luminaire module 1 is substantially spherical. Each flat face 28 further comprises a protruding lip 30, positioned around the outside circumference, protruding in the direction of the other section. When assembled, the protruding lips 30 of the two sections 15, 16 are separated and so form a circumferential slot 31. The thickness of the protruding lips 30 is such that an inner cavity 32 is formed in the space between the flat faces 28, within the protruding lips 30. The inner cavity 32 is bounded by the inner faces of the protruding lips 30 and the flat faces 28 of the sections 15, 16. The protruding lips 30 and flat faces 28 of the inner cavity 32 are electrically connected to the LED's 7 and conducting members 26 extend between the two sections 15, 16 to provide electrical connection between the LED's 7.

The connecting cables 2 comprise connection portions that engage with the circumferential slot 31 and inner cavity 32. In this embodiment the connecting cables 2 comprise two conducting members 34, 35 that are separated and surrounded by layers of insulation. The conducting members 34, 35 are positioned on opposite sides of the cable core within the outer insulation layer. Within the connecting cable 2 the combined diameter of the conducting members 34, 35 is less than the width of the circumferential slot 31 so that the cable 2 may fit through the slot 31. At the connection portion the conducting members 34, 35 extend in the longitudinal direction and the distal ends of each conducting member 34, 35 comprise a retaining portion 36 with a diameter that is similar to the space between the flat faces 28 of the inner cavity 32—larger than the width of the circumferential slot 31.

To couple a connecting cable 2 to the luminaire module 1 the two sections 15, 16 must be separated at least enough to allow the retaining portion 36 to pass through the circumferential slot 31 so that the retaining portion 36 is positioned within the inner cavity 32. When the sections 15, 16 are moved closer together the retaining portion 36 is trapped within the inner cavity 32. In this position, the outer insulation layer is positioned close to the outer face of the sections 15, 16 so that longitudinal movement of the connecting cable 2, relative to the luminaire module 1, is limited. This arrangement provides the physical support to hold the luminaire module 1. Several connecting cables 2 can be positioned around the circumferential slot 31 of the luminaire module 1 to enable different lighting networks to be created.

An electrical connection is formed between the conducting members 26 and the LED's 7 via the contact regions on the protruding lips 30 and flat faces 28 of the inner cavity 32. Each conducting member 34, 35 carries an opposite charge so it is important that each of the connecting cables 2 is coupled in the same orientation to prevent a short circuit. Alternatively, only one connecting cable carries an electric current, any others only being for physical support.

Figure 5C:
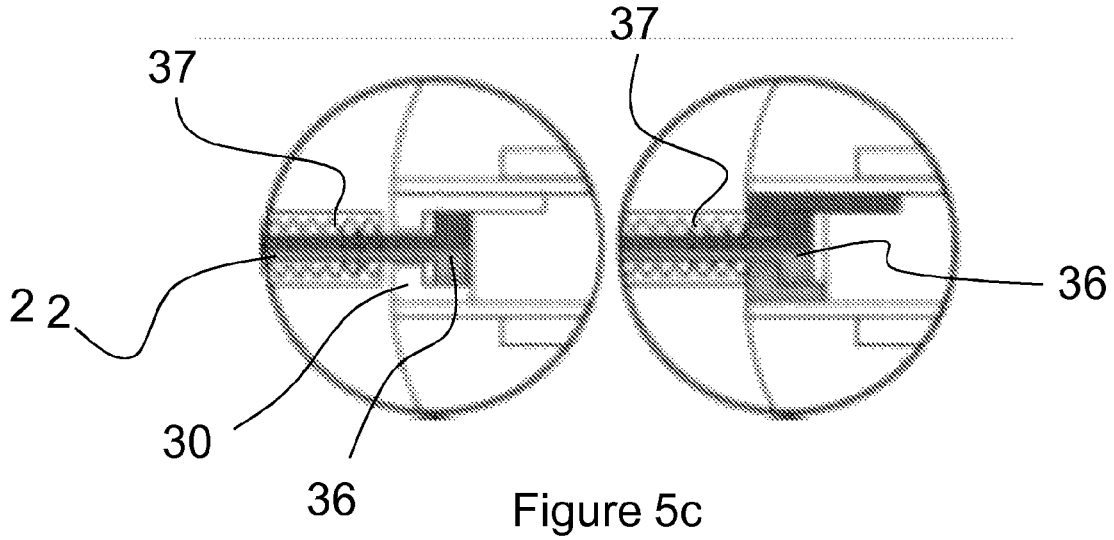

FIG. 5*c* shows a second embodiment of a track coupling for connecting the luminaire module 1 to the connecting cables 2. This embodiment is very similar to the embodiment of FIG. 5*a* but further comprises a spring 37, acting between the outer insulation layer of the cable 2 and the outer face of the sections 15, 16. The spring 37 acts to bias the retaining portion 36 of the conducting members 34, 35 against the inside face of the lips 30, maintaining the electrical connection.

Figure 5D:
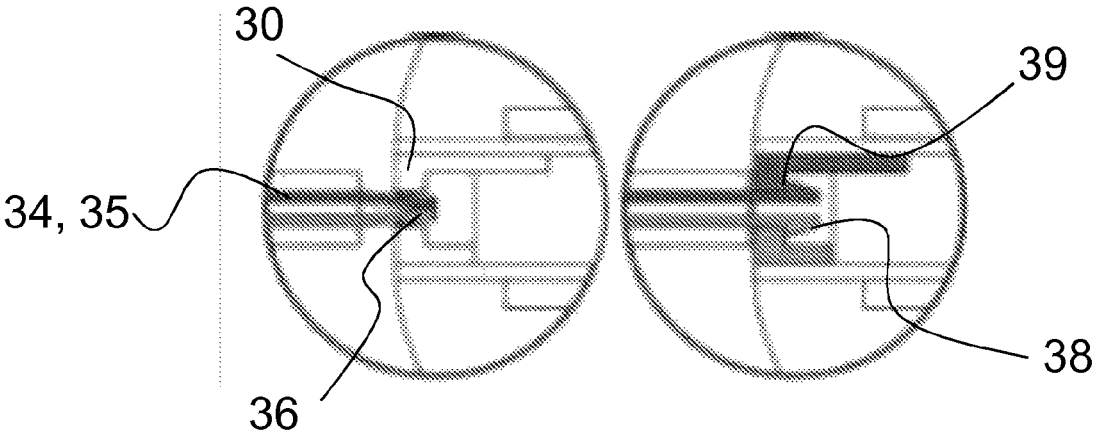

FIG. 5*d* shows a further embodiment of the track coupling. Similarly to the embodiments of FIGS. 5*a* to 5*c*, a circumferential slot 31 in the luminaire module 1 is formed between the sections 15, 16. In this embodiment the retaining portion 36 of the conducting members 34, 35 comprise a tapered end 38, being narrower than the slot 31 width at the distal end and increasing to a size larger than the slot width, returning to the core size at a step 39. This forms a snap-fit mechanism when the retaining portion 36 is pushed into the slot 31, the taper 38 causes the two conducting members 34, 35 to move together so that the retaining portion 36 can pass through the slot 31. Once the taper 38 has passed through the slot 31 the conducting members 34, 35 return to their position and the step 39 retains the conducting members 34, 35 against the inside faces of the protruding lips 30. The contact between the lip 30 and the conducting members 34, 35 provides an electrical contact. Similarly to before, the two conducting members 34, 35 carry opposite charges and the LED's are connected to the electrical contacts and to each other. The sections 15, 16 of the luminaire module do not need to be separated in order to attach the connecting cables 2, only to detach them.

Figure 5E:
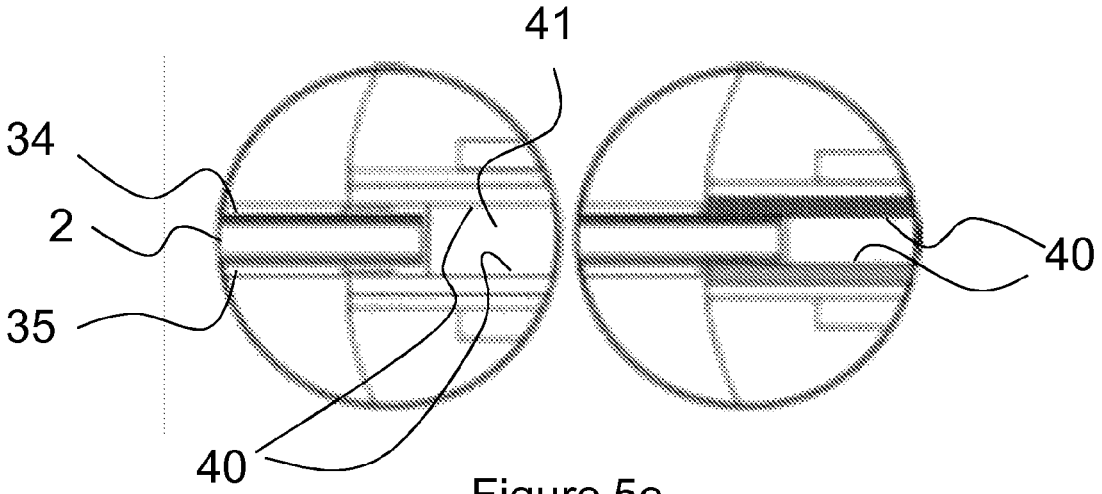

FIG. 5*e* shows yet another embodiment of the track coupling. In this embodiment, the sections 15, 16 do not comprise lips, only straight sides 40, so the area between the sections is a straight slot 41. The distance between the flat faces 40 of the sections 15, 16 is adjustable by moving a connection, such as a threaded connection (not shown), located between the two sections 15, 16. The flat faces 40 of the sections 15,16 that define the space between the sections 15, 16 are conductively connected to the LED's.

The connecting cable 2 comprises an outer insulation layer over two conducting members 34, 35 and an inner insulation core. The two conducting members are positioned on opposite sides of the cable 2. To assemble the coupling the sections 15, 16 are spaced to provide adequate space between the sections for receiving the end of the cable 2. The sections 15, 16 are then closed towards each other, pinching and crushing the cable 2. This breaks the outer insulation and creates an electrical contact between the sections 15,16 and the conducting members 34, 35. This pinching also provides a rigid attachment for physical location of the luminaire module 1.

Figure 5F:
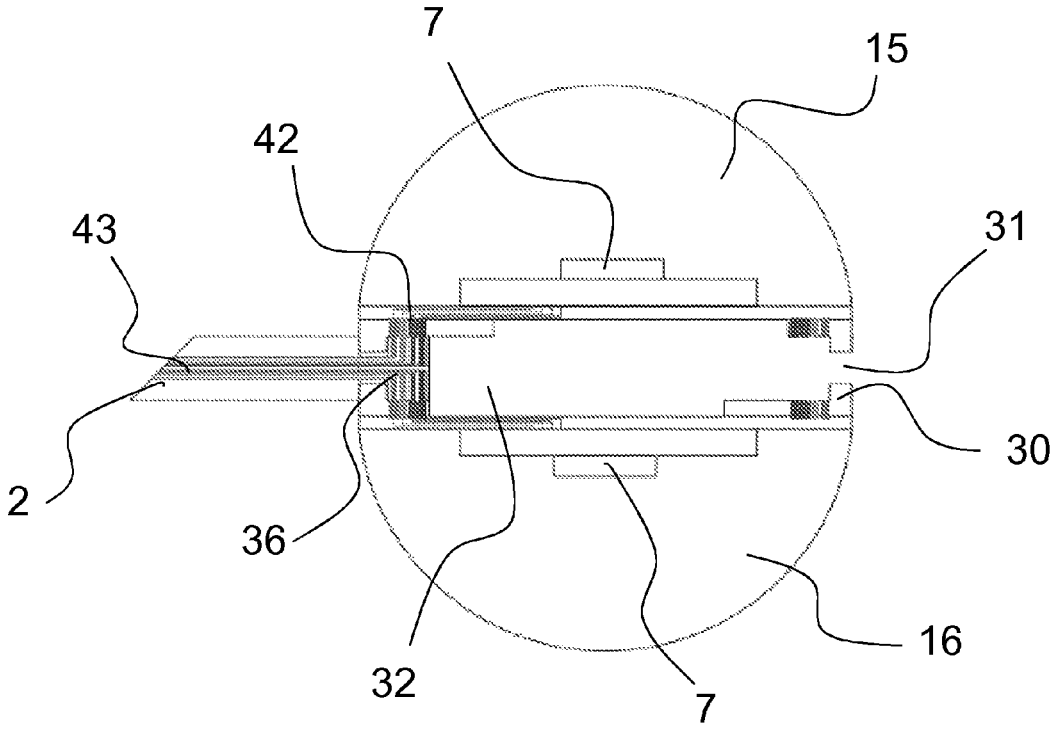

FIG. 5*f* shows a final embodiment of the track coupling. The coupling is very similar to that of FIG. 5*a*; the luminaire module 1 comprises a slot 31 and inner cavity 32 and the connecting cables 2 comprise retaining portions 36 that are retained in the inner cavity 32. The electrical contact portions 42 of the sections comprise multiple electrical contacts that are connected to the LED's 7 and to any other components, such as a controller or communication section (not shown), that may be located between the LED's 7 in the luminaire module 1. The connecting cables 2 comprise a plurality of conducting members 43 that pass into the retaining portion 36 and are connected to a plurality of electrical contacts on the outer face of the retaining portion 36. In this way, when the retaining portion 36 is located in the inner cavity 32 of the luminaire module 1 the contacts on the retaining portion 36 align with the contacts 42 on the sections 15, 16. The lips 30 of the sections 15,16 prevent the retaining portion 36 from being detached from the luminaire module 1. This arrangement provides electrical and physical connection. To attach and detach the connecting cables 2 from the luminaire module 1 the sections 15,16 must be separated to allow the retaining portion 36 to fit through the slot 31.

Figure 6:
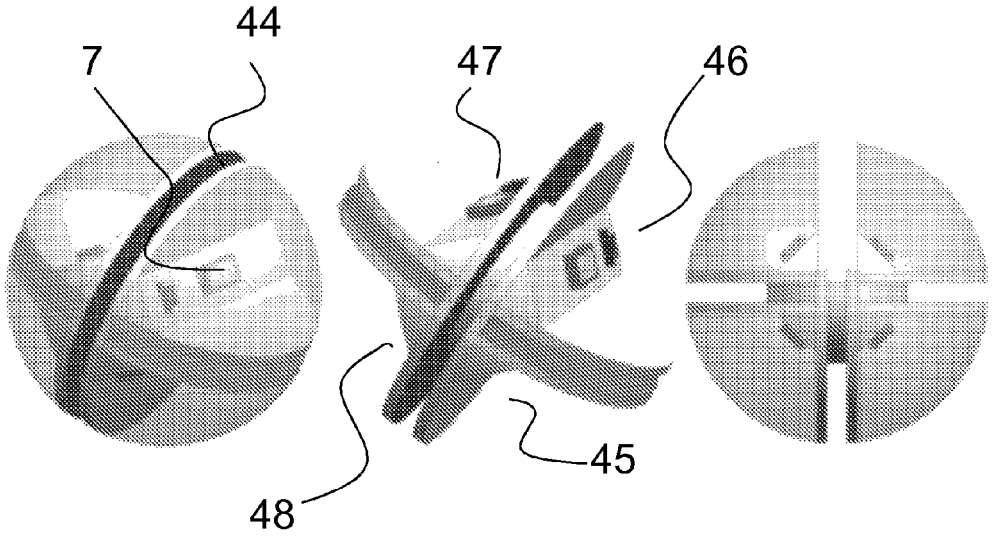
FIG. 6 shows a luminaire module with connecting slots in multiple planes.

FIG. 6 shows three views of a luminaire module 1 with slot couplings 44, similar to those described in FIGS. 5*a* to 5*f*. In this embodiment the slots 44 are located circumferentially in two perpendicular planes. This means that the luminaire module 1 comprises four sections 45, 46, 47, 48, each with its own LED 7. Four part-spherical casings cover the LED's 7 and create an overall spherical luminaire module. This arrangement allows connecting cables to be attached to the lighting section 1 from many different angles to achieve dot-in-space networks like those shown in FIGS. 1*a* to 1*j*.

It will be appreciated that for any of the embodiments described with reference to FIGS. 1 to 6, the connecting cables or rods may supply the luminaire modules with DC power, AC power or data signals for control purposes. It is also possible to combine data signals and DC power supply to reduce the required number of connecting cables. It will be appreciated that the term "comprising" does not exclude other elements or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

Other modifications and variations falling within the scope of the claims hereinafter will be evident to those skilled in the art.

The invention claimed is:

1. A luminaire module arranged to radiate light in all directions, comprising a plurality of sections each section having an LED and at least one electrical terminal opposite the LED, the sections being attachable to each other with their LED's facing outwardly so that the electrical terminals of each section face each other within the luminaire, wherein the sections are attachable to each other to provide a space between the sections and to enable support members for supporting the luminaire to extend into said luminaire from different directions.

2. A luminaire module according to claim 1, wherein the sections are attachable to each other in spaced relation to enable conductors for supplying electrical power to the electrical terminals of each section to extend into said luminaire from different directions.

3. A luminaire module according to claim 1, wherein the sections are attachable to each other in spaced relation to enable conductors for supplying control signals to the electrical terminals of each section to extend into said luminaire from different directions.

4. A luminaire module according to claim 2, wherein the conductors supply electrical power and control signals to the electrical terminals of each section.

5. A luminaire module according to claim 4, comprising two sections arranged back-to-back.

6. A luminaire module according to claim 5 wherein the sections are configured to receive a coupling ring positioned therebetween, said ring being attached to a cable and configured to make electrical contact with the electrical terminals of each section.

7. A luminaire module according to claim 6, wherein the cable extends from a perimeter edge of said ring and the ring is positionable between the sections so that the cable extends from the luminaire in any direction.

8. A luminaire module according to claim 7, wherein the coupling ring includes an electrical circuit that aligns with electrical terminals in each section irrespective of the direction in which the cable extends from said section, so that the electrical power and/or control signals are supplied to said LED's via said rings.

9. A luminaire module according to claim 8, comprising a plurality of connecting rings between the sections in stacked relation to connect a plurality of cables to the luminaire such that each cable extends from said luminaire in a different direction.

10. A luminaire module according to claim 9, wherein the sections are attached to each other via a threaded connection that extends through the centre of each connecting ring and retains the/or each connecting ring in position.

11. A luminaire module according to claim 1, wherein the sections are configured so that, when attached to each other, they together form a channel around the outside of the luminaire, a member attached to the end of a cable being captured within said channel.

12. A luminaire module according to claim 11, wherein a mechanical biasing member is attached to the cable and biases said member against a wall of the channel and the member and the channel are configured to electrically connect the cable to the electrical terminals in each section.

13. A luminaire module according to claim 11, wherein the cable is configured to form a snap-fit into the channel between the sections.

14. A lighting network comprising a plurality of luminaire modules according to claim 13, wherein said luminaire modules are coupled to each other in a three dimensional form.

* * * * *